US007866537B1

(12) United States Patent
Duhon

(10) Patent No.: US 7,866,537 B1
(45) Date of Patent: Jan. 11, 2011

(54) EASY-OPEN WRAPPER

(76) Inventor: David T. Duhon, 917 Auburn Ave., Lafayette, LA (US) 70503

( * ) Notice: Subject to any disclaimer, the term of this patent is extended or adjusted under 35 U.S.C. 154(b) by 816 days.

(21) Appl. No.: 11/823,456

(22) Filed: Jun. 27, 2007

(51) Int. Cl.
*B65D 65/26* (2006.01)
*B65D 33/00* (2006.01)

(52) U.S. Cl. ..... 229/87.05; 383/200

(58) Field of Classification Search ..... 229/87.05; 383/200; 206/441
See application file for complete search history.

(56) References Cited

U.S. PATENT DOCUMENTS

| | | | | | |
|---|---|---|---|---|---|
| 2,103,389 | A | * | 12/1937 | Salfisberg | 222/107 |
| 2,161,093 | A | * | 6/1939 | Salfisberg | 383/200 |
| 2,565,887 | A | * | 8/1951 | Salfisberg | 206/484 |
| 2,889,039 | A | * | 6/1959 | Schladermundt et al. | 206/441 |
| 3,086,647 | A | * | 4/1963 | Krezanoski | 206/363 |
| 3,259,235 | A | * | 7/1966 | Sowle | 206/497 |
| 3,343,664 | A | * | 9/1967 | Poitras | 206/219 |
| 4,418,822 | A | | 12/1983 | Dotta | |
| 4,480,751 | A | * | 11/1984 | Lueptow | 383/200 |
| 4,545,372 | A | | 10/1985 | Lauritzen | |
| 4,549,653 | A | | 10/1985 | Lauritzen | |
| 4,607,633 | A | | 8/1986 | Lauritzen | |
| 4,619,650 | A | * | 10/1986 | Wisdom | 604/408 |
| 5,397,297 | A | | 3/1995 | Hunter | |
| 5,454,601 | A | * | 10/1995 | Sekine et al. | 383/200 |
| 6,010,002 | A | | 1/2000 | Petterson | |
| 6,018,092 | A | | 1/2000 | Dunshee | |
| 6,053,318 | A | | 4/2000 | Petterson | |
| 6,140,549 | A | | 10/2000 | Pompei | |
| 6,855,861 | B2 | | 2/2005 | Dotta | |

* cited by examiner

*Primary Examiner*—Jes F Pascua
(74) *Attorney, Agent, or Firm*—Greg R. Mier

(57) ABSTRACT

A wrapper used to enclose various things that are generally flat or can be flattened. The wrapper consists of two planar sheets that are essentially identical in shape and peripherally sealed to one another. The wrapper has a v-shaped indentation on its top, which makes the wrapper easy to open by holding the wrapper at both ends near the top and gently pulling both ends away from one another until the wrapper tears into two pieces beginning at the indentation and continuing in the general direction of the bottom of said wrapper.

2 Claims, 2 Drawing Sheets

EASY-OPEN WRAPPER

FIELD OF THE INVENTION

The subject invention generally relates to easy-to-open wrappers used to enclose various things.

SUMMARY OF THE INVENTION

The wrapper of the present invention can be used to enclose various things that are generally flat or can be flattened, such as, for example, letters, paychecks, feminine pads, seasonings for food, granulized or powdered sugar, flat wooden ice cream spoons, bandages, tickets, and the like. The wrapper consists of two planar sheets that are essentially identical in shape and peripherally sealed to one another to form an envelope for holding things. Both sheets preferably have the shape of two substantially identical right trapezoids lying in the same plane in mirror-image relationship to each other, where the two right trapezoids are joined together along the shorter of the two parallel edges of the right trapezoids. This preferred configuration results in a wrapper having a shallow v-shaped top. The shallow v-shaped top has an indentation generally where the two mirror-imaged right trapezoids join together.

The wrapper is easily opened by holding both ends near the top of the wrapper and gently pulling both ends away from one another until the wrapper tears into two pieces beginning at the indentation and continuing in the general direction of the bottom of the wrapper. The combination of the indentation and the shallow v-shaped top of the wrapper result in a unique and consistently easy-to-open wrapper.

BRIEF DESCRIPTION OF THE DRAWINGS

The invention will be better understood by reference to the accompanying drawings wherein.

DESCRIPTION OF THE INVENTION

While the present invention may be described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof) falling within the scope of the appended claims.

It is initially noted that wrapper 10 can be used to enclose various things that are generally flat or can be flattened, such as, for example, letters, paychecks, feminine pads, seasonings for food, granulized or powdered sugar, flat wooden ice cream spoons, bandages, tickets, and the like. The nature of the things enclosed in wrapper 10 will determine the material of construction for wrapper 10. Those things that are water soluble, such as granulized sugar, require a material of construction that is water proof or water resistant. Those things that need to remain sterile, such as bandages, require a material of construction that is both waterproof and resistant to the entry of bacteria.

Figure 1:
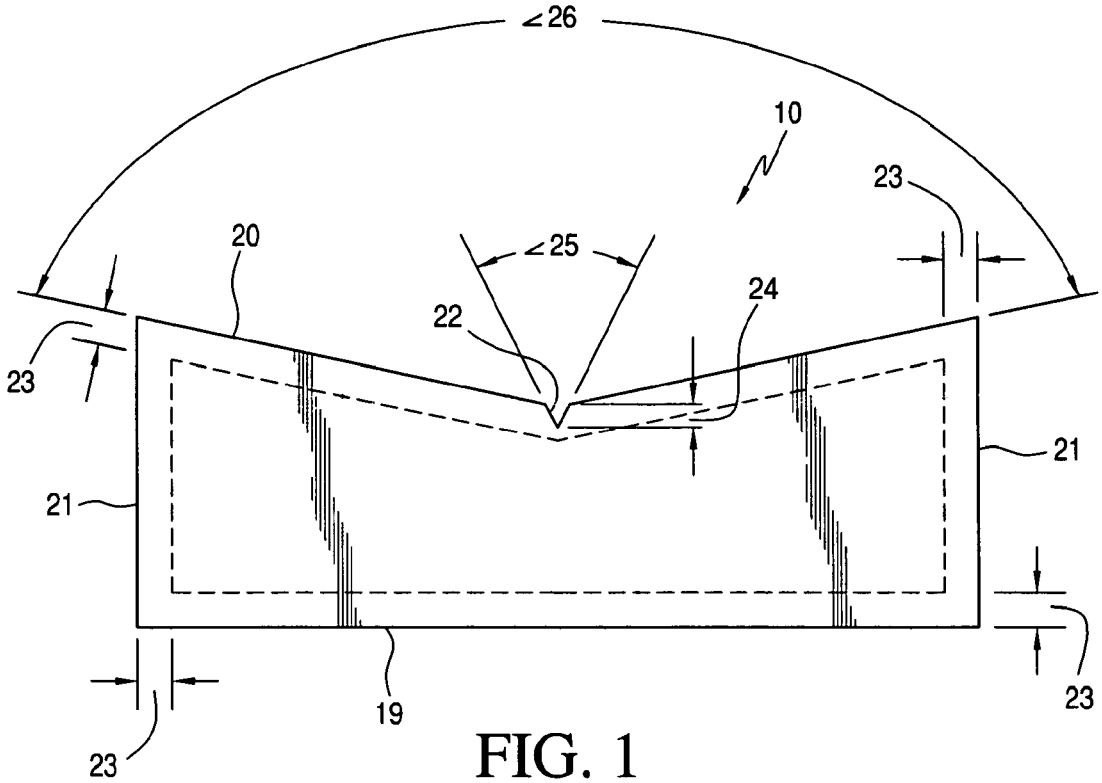
FIG. 1 is a front view of the invention.
Figure 2:
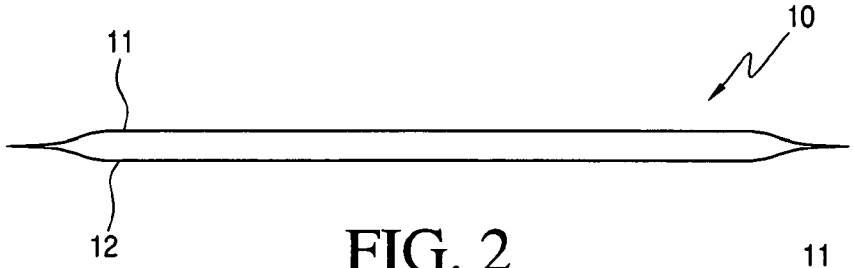
FIG. 2 is a top view of the invention.
Figure 3:
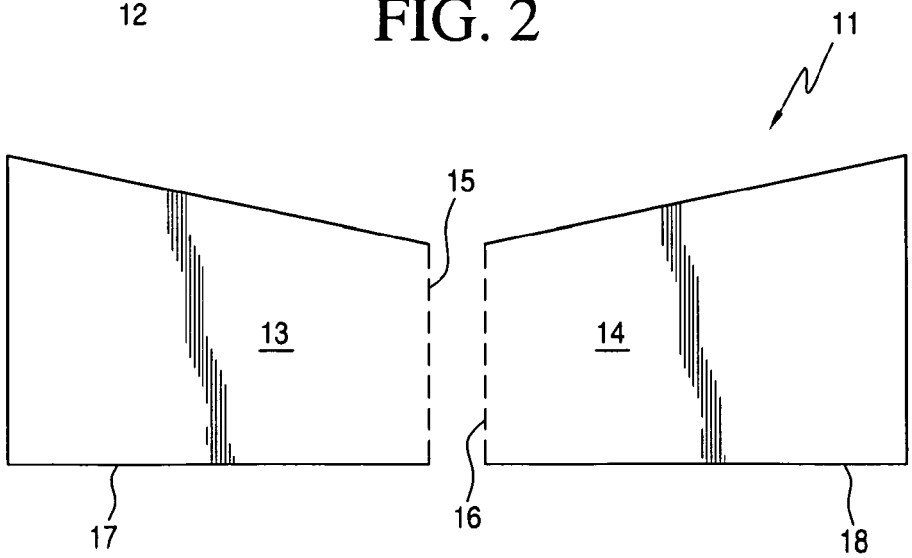
FIG. 3 is an exploded front view of the invention.
Figure 5:
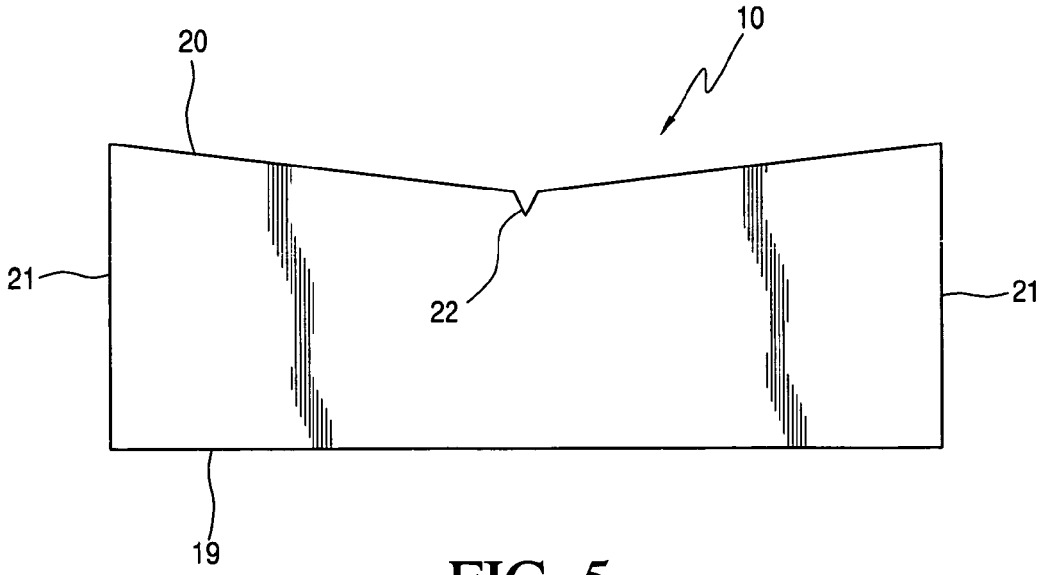
FIG. 5 is a front view of an alternative embodiment of the invention.

As shown in FIG. 2, wrapper 10 consists of first sheet 11 and second sheet 12. As shown in FIG. 3, first sheet 11 preferably has the shape of two substantially identical right trapezoids 13 and 14 lying in the same plane in mirror-image relationship to each other, where right trapezoids 13 and 14 are joined together along edges 15 and 16, and where edges 17 and 18 align to form bottom 19 of wrapper 10, as shown in FIG. 1. Edge 15 is the shorter of the two parallel edges of right trapezoid 13, whereas edge 16 is the shorter of the two parallel edges of right trapezoid 14. Edge 17 is adjacent to both right angles in right trapezoid 13, whereas edge 18 is adjacent to both right angles in right trapezoid 14. This preferred configuration results in a shallow v-shaped top 20 of wrapper 10. An alternative configuration has a shallow concave top 20, as shown in FIG. 5.

First sheet 11 and second sheet 12 are essentially identical in shape. Second sheet 12 is not actually illustrated in FIG. 1, but it should be obvious that because second sheet 12 is essentially identical in shape to first sheet 11, second sheet 12 is indistinguishable from first sheet 11 as shown in FIG. 1.

As shown in FIG. 1, first sheet 11 and second sheet 12 each have an indentation 22 on top 20 of wrapper 10. Indentation 22 is preferably positioned at the lowest point of the shallow top 20 of wrapper 10, preferably where the two mirror-imaged right trapezoids join together, as explained above in the context of FIG. 3. The angle 25 of indentation 22 is preferably less than the angle 26 of top 20.

As shown in FIGS. 1 and 2, first sheet 11 and second sheet 12 are peripherally sealed to each other to form an envelope for holding things within the non-sealed portions of first sheet 11 and second sheet 12. The depth 23 of the sealed portion of first sheet 11 and second sheet 12 is slightly deeper than the depth 24 of indentation 22 to ensure that wrapper 10 is sealed around its entire periphery, including the area in the immediate vicinity of indentation 22.

Figure 4:
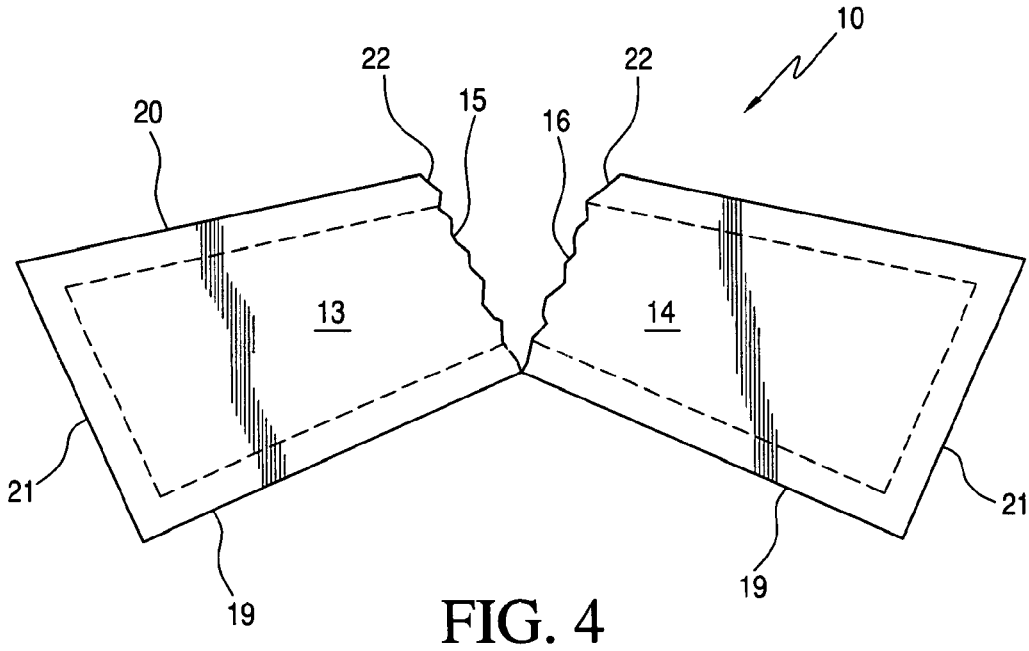
FIG. 4 is a front view of the invention showing the wrapper as it is torn apart.

The preferred method of opening wrapper 10 is to hold wrapper 10 at both ends 21 near top 20 and gently pull both ends 21 away from one another until wrapper 10 begins to tear into two pieces beginning at indentation 22 and continuing in the general direction of bottom 19, as shown in FIG. 4. The combination of indentation 22 and the shallow v-shaped profile of top 20 results in a unique and consistently easy to open wrapper.

While the above description contains many specificities, these should not be construed as limitations on the scope of the invention, but rather as an exemplification of one preferred embodiment thereof. Many other variations are possible. Accordingly, the scope of the present invention should be determined not by the embodiment(s) illustrated, but by the appended claims and their legal equivalents.

What is claimed is:

1. A wrapper comprising:

(a) a first sheet generally having the shape of two substantially identical right trapezoids joined together in the same plane along a common edge in mirror-image relationship to each other, said common edge being along the shorter of the two parallel sides of each right trapezoid, to form a shallow v-shaped top, two ends, and a bottom;

(b) a second sheet shaped substantially similar to said first sheet, said second sheet having a shallow v-shaped top, two ends, and a bottom, where said second sheet is peripherally sealed in a mirror-image relationship to said first sheet to form an envelope between said first and second sheets;

(c) an indentation in said shallow v-shaped top of said first and second sheets, said indentation located where the obtuse angles of the right trapezoids join together in said first and second sheets, whereby when said wrapper is held at both ends near the acute angles of the right trapezoids in said first and second sheets and said ends are gently pulled away from one another, the wrapper tears into two pieces beginning at the indentation and continuing generally toward the bottom of said first and second sheets.

2. The wrapper of claim 1 where said first and second sheets are constructed of paper.

* * * * *